US006719129B2

(12) United States Patent
Davis

(10) Patent No.: US 6,719,129 B2
(45) Date of Patent: Apr. 13, 2004

(54) CIGARETTE PACK HOLDER

(76) Inventor: Douglas A. Davis, 1071 Hickory, Windsor, Ontario (CA), N8Y 3S2

( * ) Notice: Subject to any disclaimer, the term of this patent is extended or adjusted under 35 U.S.C. 154(b) by 78 days.

(21) Appl. No.: 10/093,501

(22) Filed: Mar. 11, 2002

(65) Prior Publication Data

US 2003/0057117 A1 Mar. 27, 2003

Related U.S. Application Data

(63) Continuation-in-part of application No. 09/986,968, filed on Nov. 13, 2001.

(51) Int. Cl.[7] ..... A24F 15/00
(52) U.S. Cl. ..... 206/86; 206/804
(58) Field of Search ..... 206/242, 248, 206/249, 254, 255, 260, 320, 804, 815, 86; 224/269, 271, 678, 679; 24/3.1, 3.7, 3.11, 3.12, 3.13

(56) References Cited

U.S. PATENT DOCUMENTS

| | | | | | |
|---|---|---|---|---|---|
| 2,811,247 | A | * | 10/1957 | Stevenson | 206/90 |
| 3,084,407 | A | * | 4/1963 | Settles | 24/3.7 |
| 3,968,874 | A | * | 7/1976 | Corey | 206/248 |
| 4,190,148 | A | * | 2/1980 | Schade et al. | 206/89 |
| 4,194,657 | A | * | 3/1980 | Thor | 224/667 |
| 4,230,224 | A | * | 10/1980 | Weeks | 206/87 |
| 4,928,823 | A | * | 5/1990 | Campbell | 206/338 |
| 5,381,922 | A | * | 1/1995 | Gladman et al. | 220/481 |
| 5,819,379 | A | * | 10/1998 | Van Hout et al. | 24/182 |
| 5,865,357 | A | * | 2/1999 | Goodwin | 224/587 |
| 5,992,618 | A | * | 11/1999 | Joh | 206/39 |
| 6,173,875 | B1 | * | 1/2001 | Eriksson et al. | 224/677 |
| 6,312,029 | B1 | * | 11/2001 | Renforth | 294/1.3 |

FOREIGN PATENT DOCUMENTS

JP 4-231906 * 8/1992

* cited by examiner

*Primary Examiner*—Shian Luong
(74) *Attorney, Agent, or Firm*—Manelli Denison & Selter; Edward J. Stemberger

(57) ABSTRACT

A cigarette pack holder adapted to receive in combination a cigarette pack containing cigarettes. The holder includes a rectangularly-shaped housing having a planar front wall; an opposing rear wall; a pair of opposing planar side walls connected to the front and back walls; a planar base at one end of the housing; the walls and the base defining therebetween a chamber to receive the pack in removable engagement; an open-ended top at the other end of the housing through which the pack can operably pass into and out of the chamber; the base having portions defining an aperture of requisite shape and size to enable entry of a human digit to effect displacement of the pack within the chamber; and retaining structure connected to the rear wall adapted to be removably retained by an object worn by a person. The holder provides for the convenient and safe carrying of a pack of cigarettes by a person on the person's attire.

14 Claims, 2 Drawing Sheets

CIGARETTE PACK HOLDER

RELATED APPLICATIONS

This is a continuation-in-part application of Ser. No. 09/986,968 filed Nov. 13, 2001.

FIELD OF THE INVENTION

This invention relates to a holder for retaining a cigarette pack to an object, particularly to a belt, shirt pocket and the like worn by a person.

BACKGROUND OF THE INVENTION

In the last few years it has been increasingly harder to buy clothes, for example, t-shirts with pockets in which packs of cigarettes can be satisfactorily carried by a person. It can be seen often on the street and at work that smokers place cigarettes in sleeves, down shirts, and in back pockets—which can cause cigarettes to be crushed. This is especially prevalent in a factory environment.

There is, therefore a need for a person that smokes to have a method by which a pack of cigarettes can be safely carried without risk of damage to or loss of the cigarettes, while the pack remains readily retrievable to the person without the need for special expensive apparatus or clothing.

SUMMARY OF THE INVENTION

It is an object of the present invention to provide a cigarette pack holder which provides for relatively safe protection from loss or damage to the cigarettes.

It is a further object to provide said holder which is conveniently portable and retrievable by a person.

Accordingly, in one aspect the invention provides a cigarette pack holder adapted to receive in combination a cigarette pack containing cigarettes, said holder comprising a rectangularly-shaped housing having
- a planar front wall;
- an opposing rear wall;
- a pair of opposing planar side walls connected to said front and rear walls;
- a planar base at one end of said housing;

said walls and said base defining therebetween a chamber to receive said pack in removable engagement;

an open-ended top at the other end of said housing through which said pack can operably pass into and out of said chamber;

said base having portions defining an aperture of requisite shape and size to enable entry of a human digit to effect displacement of said pack within said chamber; and retaining means connected to said rear wall adapted to be removably retained by an object worn by a person.

Preferably, the holder is formed of a semi-rigid, resilient material such as a plastics material, for example, a polyethylene, polyethyleneterephthalate, or more preferably, polypropylene; or a thin metal, such as, for example, aluminum or steel.

A preferred retaining means comprises an elongate lug integrally formed with and resiliently displaceable from said rear wall to retain said pack in removable engagement to said object.

A typical object, for example, is an article of attire, such as clothing, such as a belt, pocket or other part of a shirt, pants, trousers, sweaters and the like.

In more preferred embodiments, the rear wall has a portion defining a lug-receiving aperture, which, when the holder is not clipped to an object, receives the lug in a co-planar manner under the resilient flexibility of the material of the holder such that the rear wall is essentially smooth and compact. This construction enables the holder to better fit into a person's pocket or the like when it is inappropriate or inconvenient to clip the holder to the belt or the like.

Yet more preferred embodiments have an upstanding retaining member, such as a button, bumper or the like, on the inner surface of the lug at a lower part thereof, whereby the inner surface, the upstanding retaining member and rear wall constitute an object releasable embracing means. Preferably, the button, bumper and the like is integrally formed with the lug. This feature enhances the retention of the object within the resultant loop in the holder and reduces the risk of the object slipping off the holder when the person is active or sits down. When desired, the loop of the clip can be opened by the pressing of the lug at its upper inner surface to release the object.

Thus, the presence of the upstanding member provides for a most efficacious, secure, accessible, non-bulky holder.

In a further feature, the invention provides a holder as hereinabove defined in combination with a pack of cigarettes.

The cigarette pack may be tightly held within the holder or, more preferably, in just sufficient fitting engagement with the walls of the holder as to be retained therein but readily displaced therefrom in whole or in part by means of a finger or thumb.

In this specification, the term "digit" includes a finger or thumb.

In this specification the term "cigarette" includes cigarettes, cigars, cigarillos and the like.

The holder may be readily made by processes known in the art, such as for example, injection molding; or by the cutting out of a suitably shaped blank form, sealing and subsequent adhesive bonding or welding of the "boxed" holder.

BRIEF DESCRIPTION OF THE DRAWINGS

In order that the invention may be better understood, a preferred embodiment will now be described by way of example only with reference to the accompanying drawing wherein.

DETAILED DESCRIPTION OF PREFERRED EMBODIMENT

Figure 1:
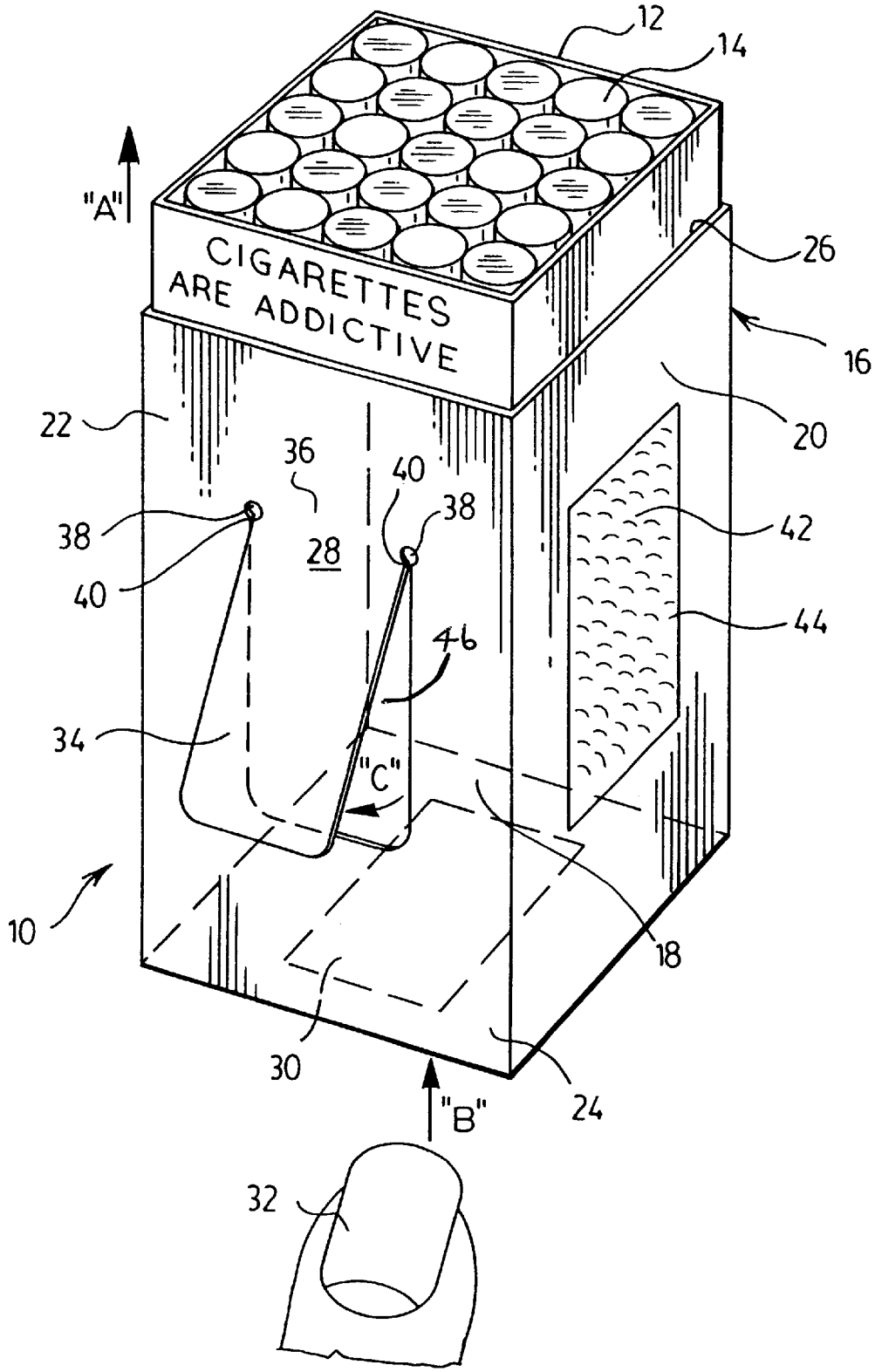
FIG. 1 is a perspective view of a cigarette pack holder according to the invention in combination with a cigarette pack containing cigarettes.

With reference to FIG. 1, this shows generally as 10 a thin walled planar, rectangular shaped holder formed of polypropylene retaining in close fitting engagement a partly displaced cigarette pack 12 containing cigarettes 14.

Holder 10 has front wall 16 opposing rear wall 18 displaced therefrom by opposing side walls 20, 22.

Holder 10 at one end has a planar base 24 and at its other end an open-top 26. Walls 16, 18, 20 and 22 and base 24 define therebetween a chamber 28 of such size and shape as to receive pack 12 in close fitting, but displaceable engagement.

Base 24 has a portion defining an aperture 30 of such shape and dimension as to permit entry of a human digit, such as a finger or thumb 32, to a sufficient extent as to effect displacement of pack 12 within chamber 28 to enable pack 12 to be either totally removed from holder 10 for, example, if it is empty; or to enable a cigarette 14 to be easier picked out of pack 12, as shown by arrows "A" and "B".

Front wall 16 has a planar surface to enable sheets bearing literature, drawings, logos, slogans, for example, advertisement and the like, (not shown) to be displayed.

Rear face 18 has a centrally located thin planar elongate lug 34, integrally formed at an upper portion 36 with rear wall 18 and operably outstanding therefrom in resiliently, flexible displacement, as shown by arrow "C". Lug 34 is operably engageable with an object or article, (not shown) such as a belt, shirt pocket or other article having a planar member of such thickness as to be received by lug 36 in removable tight fitting abutment against rear wall 18.

Rear wall portion 36 also constitutes a pair of displaced holes 38 at which upper edges 40 of lug 34 terminate. Such an arrangement has been found to reduce the risk of damage to lug 34 through undesired "running" of edges 40 if holes 38 were not present.

Side wall 20 has a central portion 42 provided with a strip 44 of "Velcro"® hooked fibres material adhered thereto, to retain a cigarette lighter or matches (not shown).

Rear wall 18 has a centrally located aperture 46 resulting from the displacement of lug 34 out of rear wall, in this embodiment by the cutting out of lug 34 therefrom. Lug 34 is operably receivable within aperture 46 as to be co-planar with rear wall 18 when desired.

Figure 2A:
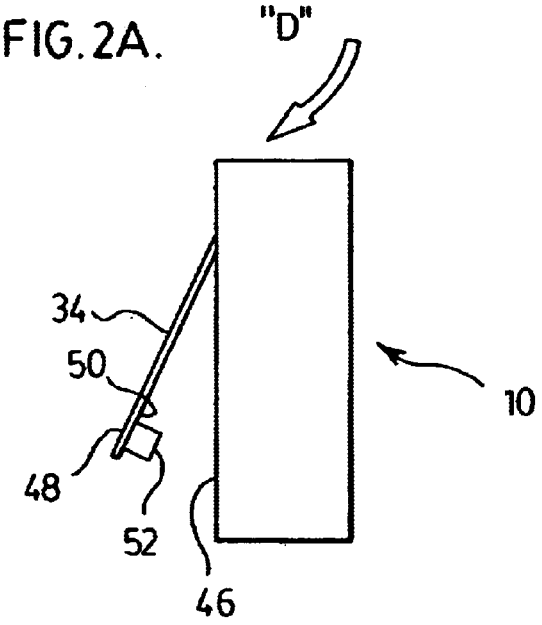
FIGS. 2A, 2B and 2C are simplified diagrammatic cross-sections of a holder in-part according to the invention in various poses; and wherein the same numerals denote like parts.
Figure 2B:
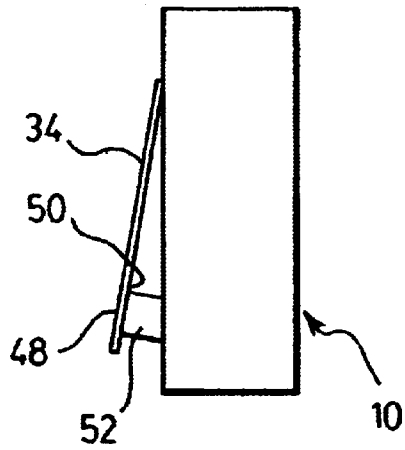
Figure 2C:
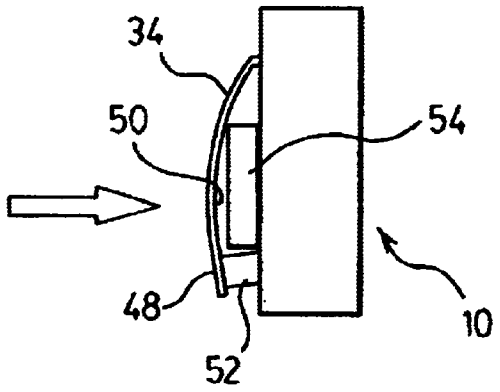

With reference to FIGS. 2A, 2B and 2C, these show holder 10 wherein lug 34 at a lower part 48 on its inner surface 50 has an upstanding button 52, opposing aperture 46. FIG. 2A has the integrally formed resilient lug displaced from aperture 46 under applied finger pressure on the inner surface of rear wall 18 as shown by arrow direction "D".

FIG. 2B shows holder 10 in a partially lug-relaxed mode, partway to be fully received in aperture 46.

FIG. 2C shows holder 10 in lug-relaxed mode embracing a belt 54, as to constitute a clip.

Thus, a closed-clip position is shown in FIGS. 2B and 2C.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

What is claimed is:

1. A cigarette pack holder constructed and arranged to receive a cigarette pack containing cigarettes, said holder comprising a rectangularly-shaped housing having a planar front wall;

an opposing rear wall;

a pair of opposing planar side walls connected to said front and back walls;

a planar base at one end of said housing;

said walls and said base defining therebetween a chamber to receive said pack in removable engagement, an open-ended top at the other end of said housing through which said pack can operably pass into and out of said chamber;

said base having portions defining an aperture of requisite shape and size to enable entry of a human digit to effect displacement of said pack within said chamber; and retaining means comprising a planar elongate lug constituting a portion of said rear wall and resiliently displaceable from said rear wall to a first position to retain said holder in removable engagement to an object worn by a person; and wherein said elongate lug comprises an inner surface operably abutable with said object; and an upstanding retaining member upstanding from said inner surface at a lower part of said elongate lug, whereby said upstanding retaining member, said elongate lug and said rear wall define a releasable object retaining means, wherein the rear wall has a portion defining an aperture such that when the elongate lug is in a second position, the upstanding retaining member is disposed in the aperture and the elongate lug closes the aperture to be substantially co-planar with the rear wall.

2. A holder as defined in claim 1 formed of a semi-rigid resilient material.

3. A holder as defined in claim 2 wherein said material is selected from a plastics material or a metal.

4. A holder as defined in claim 3 wherein said plastics material is selected from a polyethylene, polypropylene or polyethyleneterephthalate.

5. A holder as defined in claim 4 wherein said front, rear and side walls are of such dimensions as to abut said pack as to retain said pack in close fitting engagement within said chamber.

6. A holder as defined in claim 3 wherein said metal is aluminum.

7. A holder as defined in claim 6 wherein said front, rear and side walls are of such dimensions as to abut said pack as to retain said pack in close fitting engagement within said chamber.

8. A holder as defined in claim 3 wherein said front, rear and side walls are of such dimensions as to abut said pack as to retain said pack in close fitting engagement within said chamber.

9. A holder as defined in claim 2 wherein said front, rear and side walls are of such dimensions as to abut said pack as to retain said pack in close fitting engagement within said chamber.

10. A holder as defined in claim 1 wherein said upstanding retaining member is integrally formed with said lug.

11. A holder as defined in claim 1 wherein at least one of said side walls or said front wall has second retaining means adapted to removably retain ignition means selected from a cigarette lighter and matches to said holder.

12. A holder as defined in claim 11 wherein said second retaining means comprises hooked fibres.

13. A holder as defined in claim 1 wherein said front, rear and side walls are of such dimensions as to abut said pack as to retain said pack in close fitting engagement within said chamber.

14. A combination comprising a holder as defined in claim 1 retaining a cigarette pack within said chamber.

* * * * *